United States Patent [19]

Merry

[11] Patent Number: 4,677,789

[45] Date of Patent: Jul. 7, 1987

[54] WINDOW BAR ASSEMBLY

[76] Inventor: Mark A. Merry, 190 Johnson La., Tickfaw, La. 70466

[21] Appl. No.: 825,258

[22] Filed: Feb. 3, 1986

[51] Int. Cl.[4] ..... E06B 3/68

[52] U.S. Cl. ..... 49/56; 49/141; 49/395

[58] Field of Search ..... 49/141, 56, 55, 50, 49/67, 57, 395

[56] References Cited

U.S. PATENT DOCUMENTS

| | | | |
|---|---|---|---|
| 1,262,927 | 4/1918 | Derhammer | 49/395 X |
| 2,668,729 | 2/1954 | Watters | 49/141 X |
| 2,711,565 | 6/1955 | Levin | 49/56 X |
| 3,087,750 | 4/1963 | Kelly | 49/56 X |
| 4,249,345 | 2/1981 | Littleton | 49/141 X |
| 4,283,882 | 8/1981 | Hubbard et al. | 49/141 |
| 4,384,428 | 5/1983 | Cox | 49/56 |

*Primary Examiner*—Philip C. Kannan

*Attorney, Agent, or Firm*—George A. Bode; D. Neil LaHaye

[57] ABSTRACT

A window guard assembly having a first stationary frame rigidly attached to a window opening having a second frame hingedly attached thereto and sized to closely fit within the first frame. A grate is rigidly attached to the second frame. To prevent unauthorized entry, a channel attached to the second frame has a pair of locking bars slidably mounted in the channel and movable into engagement with apertures in both frames to lock the second frame in its closed position. A lever handle and extension arm are pivotally attached to the locking bars to cause movement between their locking and release positions.

17 Claims, 6 Drawing Figures

WINDOW BAR ASSEMBLY

BACKGROUND OF THE INVENTION

1. Field of the Invention

The present invention relates to window security grates and in particular to security grates which can be opened in an emergency to provide an exit.

2. General Background

The use of bars or gratings over windows has become a common practice to help prevent breakage and to prevent unauthorized entrance into the building by prowlers or burglars who may gain access through windows. A common problem presented by such security devices is that of retaining an exit for inhabitants of the building in the event of an emergency such as fire, while still providing security against unathorized entrance.

Several attempts have been made in the known art to address such a problem.

U.S. Pat. No. 4,019,281 entitled "Quick Release Window Guard" teaches vertical bars welded at their ends to upper and lower horizontal cross bars which are bent rearwardly and secured to a building over a window. One end is loosely hinged to the building with joints near the opposite end held by a hidden bolt. A cable through the cross bars into the building allows for removal of the bolt for opening the bars.

U.S. Pat. No. 3,087,750 entitled "Locking Device For Window Guards" teaches a U-shaped member provided with a crank pin cooperating with a sloted bracket attached to a double ended rod. Raising the U-shaped member and resting it against the window locks the window guard and lowering it by breaking or opening the window unlocks it.

U.S. Pat. No. 4,249,345 entitled "Releasable Window Guard" teaches a latch member which controls the vertical locking mechanism. A guard assembly forms an enclosure around the latch and has two doors, one with a vertical hinge and one with a horizontal hinge.

U.S. Pat. No. 999,682 entitled "Combined Guard And Screen For Windows" teaches a first and second bar fixed to opposite sides of a window frame, a third bar pivotally attached near the second bar, cross bars received by sockets and notches in the three bars and a lock to secure the free end of the third bar to the second bar.

U.S. Pat. No. 1,979,808 entitled "Window Attachment" teaches a frame hingedly attached to a window sill to form a platform when opened and held in the closed position by slots which receive a horizontal frame rod.

U.S. Pat. No. 1,854,153 entitled "Window Guard" teaches a removable stop to limit window sash vertical movement and a grill which bars the opposite path of the window opening in cooperation with the sash stop.

U.S. Pat. No. 4,208,837 entitled "Window Guard Having Boxed Release" teaches a guard element hingedly mounted to a wall adjacent the window with a releasable fastener in a lock housing inaccessible from outside the building when the lock bar is inserted in its latched position.

U.S. Pat. No. 4,263,747 entitled "Window Grille Latch System" teaches a spring loaded latch connected to a foot stirrup by means of cables.

SUMMARY OF THE INVENTION

The present invention solves the above problems in a simple and straight forward manner. What is provided is a first stationary frame made of metal and sized to closely fit a window opening on an exterior wall. The first frame is adapted to be rigidly attached to the wall in the window opening and has a second movable angle frame hingedly attached to one side thereof. The second frame is sized to closely fit inside the first frame when in the closed position. The hinged attachment allows the second frame to swing out away from the first frame and the building so that occupants of the building may exit through the window in the event of an emergency. The second frame has a grate rigidly attached thereto to prevent unauthorized entry through the window when the second frame is closed and secured to the first frame. The second frame is releaseably secured to the first frame for hinged movement thereon by round metal bars housed in channel which is secured to the first frame. The round bars are moveable into a first locking position wherein they protrude through apertures in the second frame and coaxially aligned apertures in the first frame to prevent opening of the second frame. The round bars are also moveable into a second release position wherein they are retracted from the apertures and housed entirely within the channel on the second frame to allow hinged movement of the first frame on the second frame. Motion of the round bars is accomplished by a lever handle having one end pivotally attached to one end of the second round bar. The first round bar has one end of an extension member or arm pivotally attached thereto with the opposite end of the extension member being pivotally attached near the middle of the lever handle. The pivotal attachment of the round bars and extension arm to the lever handle provides for pivotal movement of the lever handle to the release position out of the channel and away from the frame to cause simultaneous vertical movement of the round bars out of engagement with the apertures in both frames. When in the locked position, the round bars are engaged in the apertures in both frames and the lever handle and extension member are housed within the channel to prevent unauthorized entry from the exterior of the building.

BRIEF DESCRIPTION OF THE DRAWINGS

For a further understanding of the nature and objects of the present invention, reference should be had to the following description, taken in conjunction with the accompanying drawings in which like parts are given like reference numerals and, wherein.

DETAILED DESCRIPTION OF THE PREFERRED EMBODIMENT

Figure 1:
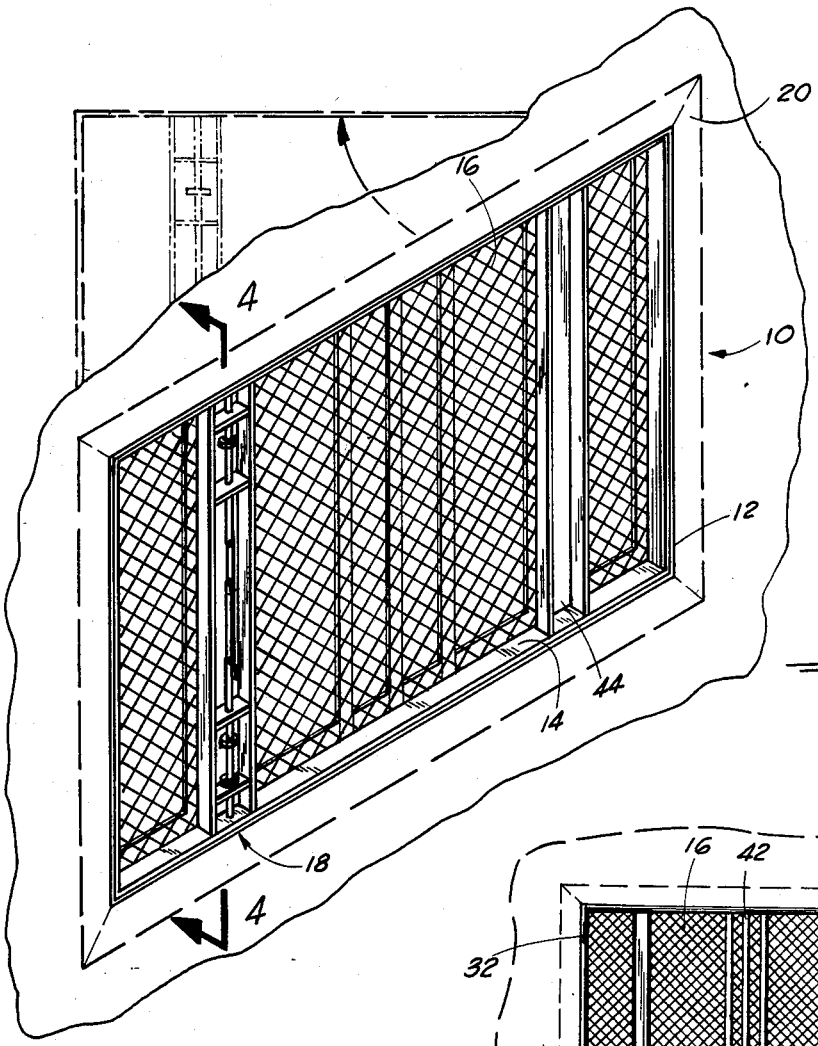
FIG. 1 is a perspective view of the invention as it appears installed from the interior of a building.
Figure 2:
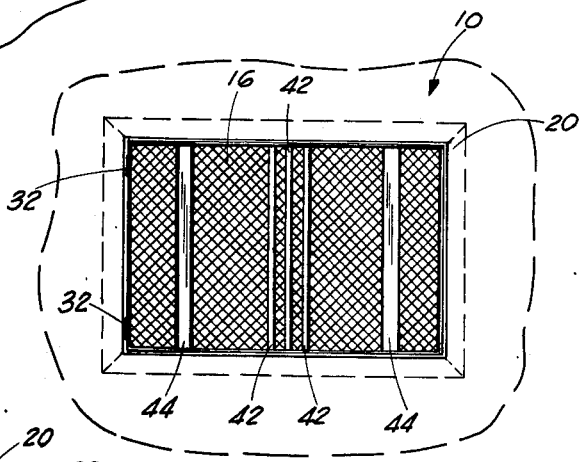
FIG. 2 is a plan view of the invention as it appears installed from the exterior of a building.
Figure 3:
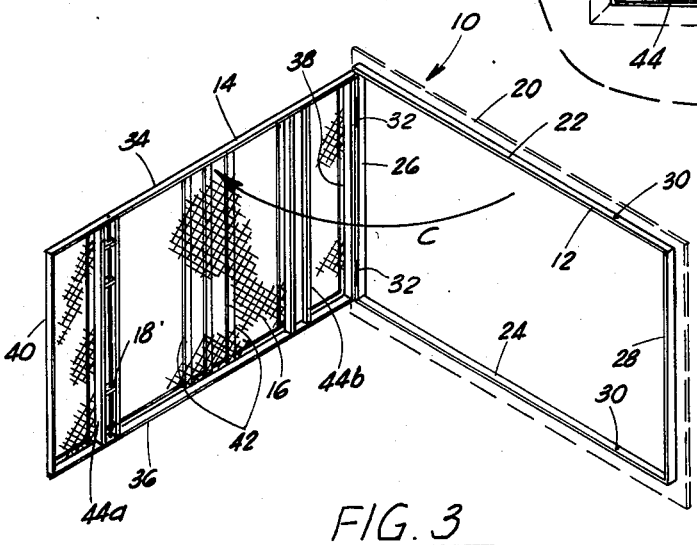
FIG. 3 is a perspective view of the invention installed when in its open position.
Figure 4:
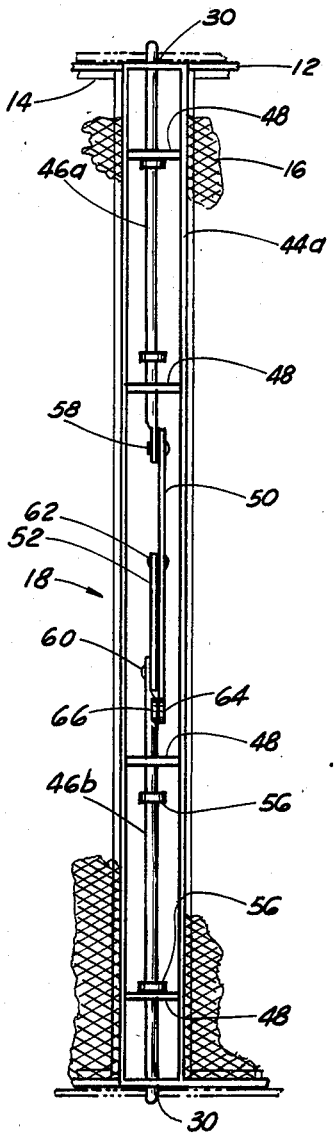
FIG. 4 is a sectional view of the locking mechanism of the invention along the Line 4—4 of FIG. 1.
Figure 5:
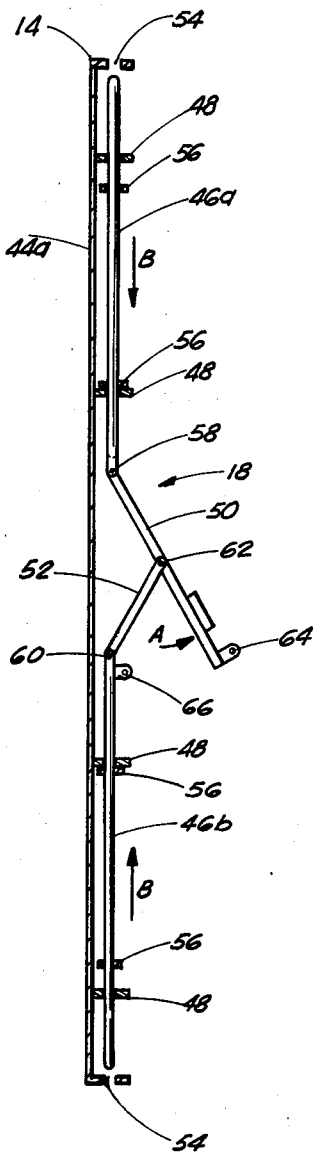
FIG. 5 is a side view of the locking mechanism of FIG. 4 in the release position.
Figure 6:
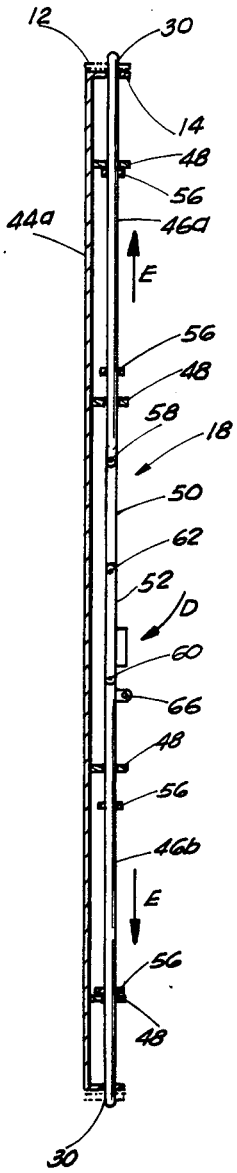
FIG. 6 is a side view of the locking mechanism of FIG. 4 in the locking position.

Referring now to the drawings, it can be seen in FIGS. 1–3 that the window bar or guard assembly of the present invention is generally referred to by the numeral 10. Window guard assembly 10 is generally comprised of first stationary frame 12, second movable frame 14, grate 16, and means 18 for releaseable locking second movable frame 14 in place with first stationary frame 12, as best seen in FIGS. 4–6.

First stationary frame 12 is perferrably constructed from any suitable material such as iron, steel, or other metal alloy having sufficient strength to prevent unauthorized removal from building 20. First frame 12 may be of a rectangular or square shape to closely fit a window opening, as illustrated in FIGS. 1–3, and formed from four frame members such as flat bar or angle members joined at their ends by any conventional means such as welding to define a top 22, bottom 24, first side 26, and second side 28. For purposes of illustration, first frame 12 is shown as being constructed from flat bar, but it should be understood that any suitable shapes maybe utilized. First frame 12 is adapted to be rigidly secured within the window opening to building 20 by any suitable means such as studs, rivets, screws or nails. First frame 12 is provided with apertures 30 on two opposed frame members such as top 22 and bottom 24, the purpose of these to be explained hereinafter. First frame 12 is also provided with hinges 32 attached to one side such as first side 26 for hinged attachment of second frame 14 thereto.

Second movable frame 14 is also preferrably constructed from metal such as angle iron and formed of four frame members joined at their ends by any suitable means such as welding to define a top 34, bottom 36, first side 38, and second side 40. Second frame 14 is sized to closely fit within first frame 12 and has one side such as first side 38 attached to hinges 32. This serves as a means for movement of second frame 14 relative to first frame 12 between a first closed position as seen in FIG. 2 and a second open position as seen in FIG. 3. To prevent unauthorized entry, grate 16 is rigidly attached to second frame 14 by any conventional means such as welding. Grate 16 is preferrably formed from a heavy metal as are first and second frames 12, 14 and may be a lattice work as illustrated or a series of parallel bars. Means for reinforcing grate 16 such as bars 42 and channels 44 may also be provided. Bars 42 are illustrated as flat bars but may be of any suitable shape such as round bars and are rigidly attached at each end to second frame 14. Channels 44 extend between top 34 and bottom 36 of second frame 14 and are rigidly attached thereto by conventional means such as welding. Channels 44 are preferrably formed from heavy metal as are bars 42 and in addition to providing increased surface area for attachment of grate 16, also serve as a means for housing the locking means 18.

Locking means 18 is preferrably housed within channel **44*a* positioned near the opposite end of second frame 14 which is hingedly attached to first frame 12 (best seen in FIG. 3) and generally comprised of round bars 46*a*, 46*b*, level handle 50 and extension arm 52**.

Referring now to FIGS. 4–6, channel member **44*a* is provided with means for slidably receiving and retaining and guiding bars 46*a*, 46*b* such as a plurality of cross members 48 rigidly secured within channel 44*a* along the length thereof. Cross members 48 are preferrably positioned near top 34 and bottom 36 of second frame 14 so as not to interfere with the movement of lever handle 50 and extension arm 52 during operation and to allow lever handle 50 and extension arm 52 to be housed within channel 44*a* when in the first locking position. Round bars 46*a*, 46*b* normally extend through apertures provided in upper cross members 48 and also through apertures 54 and 30 in second frame 14 and first frame 12 repectively when in the first locking position (best seen in FIGS. 4 and 6). When in the second release position, round bars 46*a*, *b* remain in position within the apertures in cross members 48 but do not protrude through apertures 54 and 30, thus allowing opening of second frame 14. Round bars 46*a*, *b* are provided with means for limiting their vertical travel such as stops or washers 56 attached thereto between each set of cross members 48. As best seen in FIGS. 4 and 5, round bar 46*a* is pivotally attached at its lower end to the upper end of lever handle 50 by means of first pin 58 journaled through apertures provided in each member. Round bar 46*b* has its upper end pivotally attached to the lower end of extension arm 52 by means of second pin 60 journaled through apertures provided in each member. Extension arm 52 has its upper end pivotally attached to lever handle 50 near its mid-section by third pin 62** journaled through apertures provided in each member.

In operation, it can thus be seen in FIG. 5 that the motion of lever handle 50 out of channel **44*a* in the direction indicated by ARROW A causes round bars 46*a*,*b* to move inwardly to the second release position toward the center of channel 44*a* as indicated by ARROWS B. Round bars 46*a*,*b* are thus disengaged from apertures 30, 54 and allow hinged movement of second frame 14 to the second release or open position on first frame 12 as indicated by ARROW C in FIG. 3. As illustrated in FIG. 6, when lever handle 50 is moved inwardly toward channel 44*a* in the direction of ARROW D, round bars 46*a*,*b* move vertically in the direction indicated by ARROW E into apertures 54, 30 and the first locking position in response to pressure from lever handle 50 and extension arm 52. Second frame 14 is then secured in its first closed position and lever handle 50 and extension arm 52 are housed within channel 44*a*** to prevent tampering from the exterior.

Lever handle 50 and round bar **46*b* may be provided with protrusions 64, 66 near there respective lower and upper ends which are in alignment when in the first locking position. Protrusions 64, 66 may also be provided with apertures for receiving a lock to serve as a means for securing locking means 18 in the first locking position. It should be noted that round bars 46*a*,*b* are illustrated and described as being round for illustrative purposes only and they may be of any other suitable shape such as flat bars. It may also be necessary to provide bars in the frame of the window opening of building 20 to allow round bars 46*a*,*b* to protrude sufficiently through apertures 30 in first frame 12 to insure that locking means 18** is securely received in its first locking position.

It should be noted that second frame 14 may be hingedly attached to first frame 12 on any of the four sides with locking means 18 being located accordingly. Also, more than one locking means 18 may be used if it is so desired.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A window guard assembly comprising:

a. a first stationary rectangular frame adapted to be rigidly secured within a window opening;

b. a second rectangular frame hingedly attached to said first frame and movable between a first closed position within said first frame and a second open position;

c. a closure grating rigidly attached to said second frame, thereby preventing manual access therethrough; and d. means for releasably locking said second frame in said first closed position, said locking means being movable between a first locking position whereby said locking means is in engagement with said first and second frames and a second release position whereby said means is disengaged from said first and second frames, said locking means being housed in a channel member rigidly attached to said second frame and closure grating, said channel member extending vertically within said second frame between the top and bottom thereof and being open only opposite said closure grating to thereby provide access to said locking means from inside said window.

2. The device of claim 1, wherein said first frame is constructed from flat bar.

3. The device of claim 1, wherein said second frame is constructed from angle material.

4. The device of claim 1, further comprising means for reinforcing said grate.

5. The device of claim 1, wherein said locking means comprises:

a. said first and second frames each having apertures therein, said apertures being coaxially aligned when said second frame is in said first closed position;

b. a first elongated rigid bar slidably attached to said second frame and aligned with said apertures;

c. an extension arm pivotally attached to said first bar;

d. a second elongated rigid bar slidably attached to said second frame and aligned with said apertures; and e. a lever handle pivotally attached to said second bar and said extension arm, whereby movement of said lever handle between said first locking position and said second release position causes said first and second bars to respectively protrude through and retract from said apertures.

6. The device of claim 5, wherein said first and second bars and extension arm and lever are vertically aligned and housed within said channel member in said first locking position.

7. The device of claim 1, wherein said first and second frames are constructed from a heavy metal.

8. A window guard assembly comprising:

a. a first stationary rectangular frame constructed from flat bar and adapted to be rigidly secured within a window opening;

b. a second rectangular frame constructed from angle material and hingedly attached to said first frame and movable between a first closed position within said first frame and a second open position;

c. a closure grating rigidly attached to said second frame, thereby preventing manual access therethrough; and d. means for releasably locking said second frame in said first closed position, said locking means being movable between a first locking position whereby said locking means is in engagement with said first and second frames and a second release position whereby said means is disengaged from said first and second frames, said locking means being housed in a channel member rigidly attached to said second frame and closure grating, said channel member extending vertically within said second frame between the top and bottom thereof and being accessible only opposite said closure grating to thereby provide access to said locking means from inside said window.

9. The device of claim 8, further comprising means for reinforcing said grate.

10. The device of claim 8, wherein said locking means comprises:

a. said first and second frames each having apertures therein, said apertures being coaxially aligned when said second frame is in said first closed position;

b. a first elongated rigid bar slidably attached to said second frame and aligned with said apertures;

c. an extension arm pivotally attached to said first bar;

d. a second elongated rigid bar slidably attached to said second frame and aligned with said apertures; and e. a lever handle pivotally attached to said second bar and said extension arm, whereby movement of said lever handle between said first locking position and said second release position causes said first and second bars to respectively protrude through and retract from said apertures.

11. The device of claim 10 wherein said first and second bars and extension arm and lever are vertically aligned and housed within said channel member in said first locking position.

12. The device of claim 8, wherein said first and second frames are constructed from a heavy metal.

13. A window guard assembly comprising:

a. a first stationary rectangular frame constructed from flat bar and adapted to be rigidly secured within a window opening and having coaxially aligned apertures on two opposing sides;

b. a second rectangular frame constructed from angle material and hingedly attached to said first frame and movable between a first closed position within said first frame and a second open position and having coaxially aligned apertures on two opposing sides in alignment with said apertures in said first frame when in said first closed position;

c. a closure grating rigidly attached to said second frame, thereby preventing manual acces therethrough;

d. a first elongated rigid bar slidably attached to said second frame in alignment with said apertures;

e. a second elongated rigid bar slidably attached to said second frame in alignment with said apertures;

f. an extension arm pivotally attached to said first bar;

g. a lever handle pivotally attached to said second bar and said extension arm and movable between a first locking position and a second release position, said first and second bars protruding through said apertures in response to movement of said lever handle into said first locking position, thereby locking said second frame in its first closed position, and retracting from said apertures in response to movement of said lever handle to said second release position, thereby allowing hinged movement of said second frame into said second open position; and h. a channel member rigidly attached to said second frame and closure grating and extending vertically within said second frame between the top and bottom thereof and being accessible opposite said closure grating, said channel member thereby providing a housing for said first and second bars.

14. The device of claim 13, further comprising means for reinforcing said grate.

15. The device of claim 14, wherein said reinforcing means comprises a plurality of bars rigidly attached to said second frame across said grate.

16. The device of claim 13, wherein said first and second bars and extension arm and lever are vertically aligned and housed within said channel in said first locking position.

17. The device of claim 13, wherein said first and second frames are constructed from a heavy metal.

* * * * *